United States Patent [19]

Hulek

[11] 3,995,870

[45] Dec. 7, 1976

[54] PROCESS OF MANUFACTURING WROUGHT-IRON LATTICES

[76] Inventor: Anton Hulek, Goglerfeldgasse 15, Linz, Austria

[22] Filed: Nov. 28, 1975

[21] Appl. No.: 635,877

[30] Foreign Application Priority Data

Dec. 2, 1974 Austria ..... 9628/74

[52] U.S. Cl. ..... 219/58; 29/243.56; 29/509; 29/515; 140/93 D; 256/45

[51] Int. Cl.[2] ..... B23K 1/00; B23K 9/00; B23K 11/00; B23K 15/00

[58] Field of Search ..... 29/509, 515, 160, 243.56, 29/243.57; 256/27, 45, 47, 57; 140/93 D, 11; 228/136; 219/100, 58

[56] References Cited

UNITED STATES PATENTS

| | | | |
|---|---|---|---|
| 386,124 | 7/1888 | Hainsworth | 29/160 |
| 1,552,269 | 9/1925 | Brocker | 140/11 |
| 1,705,821 | 3/1929 | Lehmann et al. | 29/243.57 X |
| 2,238,779 | 4/1941 | Mosebach | 219/58 X |
| 2,345,641 | 4/1944 | Van Sant | 219/58 |
| 2,461,030 | 2/1949 | Brickman | 140/93 D X |
| 2,972,791 | 2/1961 | Kelem | 29/243.56 UX |
| 3,503,119 | 3/1970 | Seitz et al. | 29/243.56 X |
| 3,592,998 | 7/1971 | Derclaye | 219/58 X |

*Primary Examiner*—Charlie T. Moon
*Attorney, Agent, or Firm*—Kurt Kelman

[57] ABSTRACT

Pre-shaped wrought-iron rods are placed one beside another in a lattice array, in which node-forming portions of adjacent rods are disclosed close to each other at a plurality of node positions. All node-forming portions at each of said node positions are inserted into a U-shaped strip metal element having an inwardly protruding longitudinal rib. Each of said strip metal elements is joined to said node-forming portions inserted therein by a projection welding operation in which said rib is used as a projection. Each of said strip metal elements is subsequently closed to form a closed clip embracing said node-forming portions joined thereto.

7 Claims, 6 Drawing Figures

PROCESS OF MANUFACTURING WROUGHT-IRON LATTICES

Figure 1:
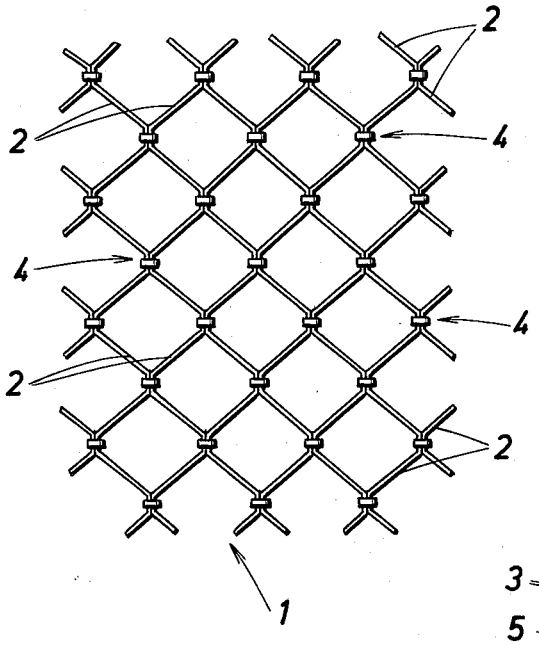

This invention relates to a process of manufacturing wrought-iron lattices, in which prefabricated round-section or edged rods are laid together to form a lattice array and are welded together or embraced with metal clips at the points of contact to form nodes.

It has been known for a long time to make nodes in wrought-iron lattices only by means of clips which consist of thick flat iron bars and hold the adjoining rods together. Whereas these clips which are forged in position by hand have a pleasing appearance, the formation of such nodes takes in most cases too much time and is too expensive. Besides, the joints formed in that the lattice rods are embraced only with the clips lack the required strength, particularly if the lattice is large in area, so that the stability of the lattice is inadequate. For this reason it is modern practice first to weld the lattice rods together at their points of contact by oxyacetylene or electric manual welding and then to cover the welded joints with clips only for the sake of appearance. Some of the wrought-iron lattices which are industrially made from thin flat iron bars bent by machine have only spot-welded nodes without clips. Whereas the clips are decorative, they are omitted in order to reduce costs, or only very thin clips made of bendable strip are bent around the welded nodes. Whereas the previously known wrought-iron lattices which are machine-welded at the nodes have a higher stability than the wrought-iron lattices which are held together only by clips, they are much less pleasing to the eye because only thin flat iron bars can be used as lattice rods and the nodes are provided only with very weak clips, if any, which cannot be compared to the strong clips forged by hand. Besides, the joining of the several lattice rods by welding has previously involved considerable difficulties because it is very complicated to compress the rods at the node positions for the welding operation. This compressing must be effected in the plane of the lattice, where there is hardly any space for the application of tools. This fact renders the welding operation difficult and adversely affects the quality of the welded joints. Moreover, round-or square section rods as well as relatively thick flat iron bars are not suitable for such welded joints, for technical or economical reasons, and the above-mentioned space requirements preclude a welding of close-meshed lattices.

It is an object of the invention to eliminate these disadvantages and to provide a process of manufacturing wrought-iron lattices which is of the kind defined first hereinbefore and permits of a simple and economical manufacture of wrought-iron lattices which have a particularly high stability and possess nodes that are pleasing in appearance.

The process according to the invention resides essentially in that the round-section or edged rods placed one beside the other are inserted into strip metal elements which have been bent into U-shape and have inwardly protruding longitudinal ribs, the rods are joined to said strip elements by a projection welding operation in which the ribs are used as projections, and the strip metal elements are then compressed to form closed clips. Because the flat electrodes can easily be inserted between the limbs of the U-shaped strip metal elements and the strip metal elements can be directly applied to the other flat electrodes or can even be embedded in the latter, the rods which lie one beside the other in the U-shaped strip metal elements can well be forced against the longitudinal ribs of the strip metal elements, as is required for a satisfactory welding. As the lattice rods extend transversely to the longitudinal ribs of the strip metal elements, there is, at most, a line contact so that the desired resistance is presented to the welding current. The welding operation itself results in a removal of some material at the points of contact between the longitudinal ribs and the lattice rods, and the molten material fills the space between the lattice rods and the strip metal element so that really strong welded joint between the lattice rods and the strip metal elements results. It will be understood that two or more lattice rods having any desired cross-section can be joined in a single node. When the welding operation has been performed, the strip metal elements joined to the lattice rods are compressed with suitable forming tools to form a closed clip, which encloses the lattice rods. The operations of forcing the lattice rods and strip metal elements together for the welding operation and of subsequently compressing the strip metal elements to form clips can be performed in a simple manner because the pressing force is directed at right angles to the lattice plane in each operation. It will be understood that the strip metal elements may have a substantial thickness so that they are pleasing in appearance. Because the strip elements bent around the lattice rods conceal also the welded joint, the resulting clips create the impression of strength associated with actual forged work. Owing to their high-strength nodes, the wrought-iron lattices according to the invention are eminently suitable for further processing, e.g., by flanging, so that a single flat lattice panel can be shaped to provide three-dimensional structures, such as basket-shaped grilles.

Within the scope of the invention it will be particularly desirable to use strip metal elements having longitudinal ribs which have been formed by a beading operation. This practice results in the use of a starting material which can be made economically and in a simple manner and the grooves formed on the outside of the clips by the bead-pressing operation add to the impression of high-strength forged work.

To enable the manufacture of wrought-iron lattices having nodes which are arranged in a row or in regular groups in a simpler manner and in shorter time, the process according to the invention may be carried out in such a manner that all nodes of a row or group may be subjected at the same time to the compression welding operation and to the operation of compressing the strip metal elements.

Figure 3:
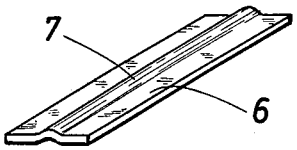
Figure 2:
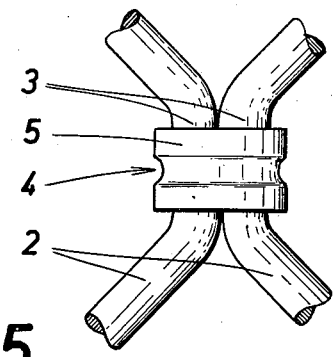
Figure 4:
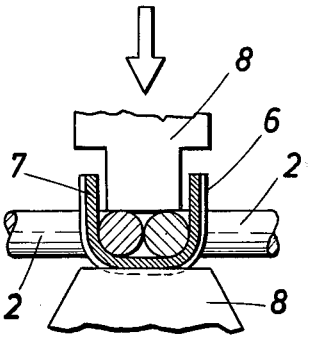
Figure 5:
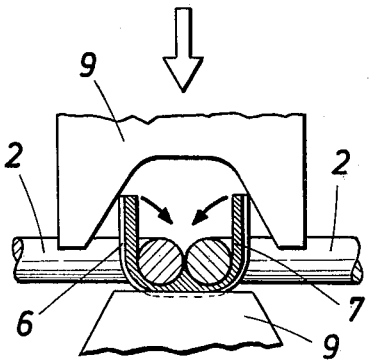
Figure 6:
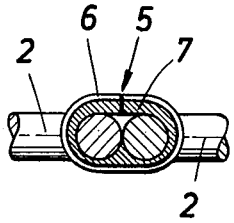

A wrought-iron lattice made by the process according to the invention is shown by way of example on the drawing, in which FIG. 1 is a top plan view showing a portion of a finished wrought-iron lattice, FIG. 2 is a side elevation showing on an enlarged scale a node of the lattice, FIG. 3 is a perspective view showing a strip metal element used to make a clip, and FIGS. 4–6 are transverse sectional views illustrating three steps involved in the making of a lattice node in accordance with the invention.

The wrought-iron lattice 1 shown in FIG. 1 consists of round-section rods 2, which have previously been bent to a zigzag shape and which have been laid together in mirror symmetry and form a node 4 at each of the points of contact between bends 3. The round-section rods 2 forming each node 4 are joined by welding and are enclosed by a clip 5.

To make the lattice 1, specifically a node 4 thereof, a strip metal element 6 formed with a longitudinal rib 7 by a beading operation is bent into U-shape in such a manner that the longitudinal rib 7 protrudes inwardly. Two juxtaposed round-section rods 2 at a node position are then inserted into the U-shaped strip metal element. Flat electrodes 8 are used to force the round-section rods 2 against the longitudinal rib 7 of the strip metal element 6 (FIG. 4) and to join the round-section rods and the strip element by a projection welding operation in which the longitudinal rib 7 of the strip metal element 6 is used as a projection. The strip metal element 6 which has thus been firmly joined to the round-section rods is thus compressed around the round-section rods by means of a forming tool 9 (FIG. 5) so that the strip element forms a closed clip 5 (FIG. 6). As the nodes 4 of the wrought-iron lattice 1 are arranged in rows, all nodes of a row can be simultaneously subjected to the projection welding operation and to the operation of compressing the strip metal elements.

The process according to the invention may be used to make wrought-iron lattices in a very simple manner, at low cost and within short time, and the resulting lattices have not only a high rigidity but are also pleasing in appearance. The specific welding operation employed in making the nodes results in a combined welded and clip joint which is of very high quality and can be made in a very economical manner. Owing to its large thickness and the rib and groove formed by the beading operations, the resulting clip creates the impression of actual manually forged work and the closed clip conceals also the welded joint. If the thickness of the lip and the lattice rods employed are properly selected, the process according to the invention will permit of a manufacture of beautiful wrought-iron lattices, which owing to their high-strength nodes can be flanged to form three-dimensional items.

It will be understood that the process according to the invention is not restricted to the manufacture of wrought-iron lattices as shown on the drawing but may be used to make wrought-iron lattices of varying shapes. The lattice rods may consist of round-section or edged rods and may be pre-shaped in accordance with various patterns. It will also be possible to join more than three or more lattice rods, rather than two, in a single node. For this purpose, all lattice rods to be joined must be inserted one beside the other. To provide also a particularly good welded joints, the strip metal elements may be provided with a plurality of parallel longitudinal ribs so that there are a larger number of points of contact between the lattice rods and the strip metal elements and the quality of the projection-welded joint is improved. The combined welded and clip joint formed in accordance with the invention may also be provided between two lattice rods which do not lie in a plane, e.g., at a corner joint.

What is claimed is:

1. A process of manufacturing wrought-iron lattices, which comprises placing pre-shaped wrought-iron rods one beside another in a lattice array, in which node-forming portions of adjacent rods are disposed close to each other at a plurality of node positions, inserting all node-forming portions to each of said node positions into a U-shaped strip metal element having an inwardly protruding longitudinal rib, joining each of said strip metal elements to said node-forming portions inserted therein by a projection welding operation in which said rib is used as a projection, and subsequently closing each of said strip metal elements to form a closed clip embracing said node-forming portions joined thereto.

2. A process as set forth in claim 1, in which said rods are round-section rods.

3. A process as set forth in claim 1, in which said rods are edged rods.

4. A process as set forth in claim 1, in which said strip metal elements are closed by the application of pressure to said strip metal elements.

5. A process as set forth in claim 1, in which said ribs consist of beads formed in said strip metal elements.

6. A process as set forth in claim 1 as applied to the manufacture of wrought-iron lattices having nodes arranged in regular groups, in which each of said steps of joining said strip metal elements to said node-forming portions and of closing said strip metal elements are carried out simultaneously at all node positions associated with the nodes of each group.

7. A process as set forth in claim 1 as applied to the manufacture of wrought-iron lattices having nodes arranged in rows, in which each of said steps of joining said strip metal elements to said node-forming portions and of closing said strip metal elements are carried out simultaneously at all node positions associated with the nodes of each row.

* * * * *